United States Patent [19]

Eyerle

[11] Patent Number: 4,628,646

[45] Date of Patent: Dec. 16, 1986

[54] COVER ARRANGEMENT FOR A SERVICING HOLE

[76] Inventor: Anton Eyerle, Stettinger Str. 14, D-8950 Kaufbeuren, Fed. Rep. of Germany

[21] Appl. No.: 705,737

[22] Filed: Feb. 26, 1985

[30] Foreign Application Priority Data

Mar. 5, 1984 [DE] Fed. Rep. of Germany ..... 3408080

[51] Int. Cl.[4] ..... E06B 9/08

[52] U.S. Cl. ..... 52/169.7; 160/133

[58] Field of Search ..... 52/169.7; 49/33; 160/133, 287, 201, 202, 204

[56] References Cited

U.S. PATENT DOCUMENTS

| | | | |
|---|---|---|---|
| 2,850,088 | 9/1958 | Purdy | 160/201 X |
| 3,341,180 | 9/1967 | Dashio | 160/201 X |
| 3,532,153 | 10/1970 | D'Anka | 160/201 |
| 3,698,346 | 10/1972 | Baur | 160/133 X |
| 3,894,571 | 7/1975 | Hinchliff | 160/201 |
| 4,156,953 | 6/1979 | Alten | 160/201 X |
| 4,341,253 | 7/1982 | Eyerle | 160/133 |

FOREIGN PATENT DOCUMENTS 2646395 5/1979 Fed. Rep. of Germany .

*Primary Examiner*—Carl D. Friedman
*Attorney, Agent, or Firm*—Angelo Notaro

[57] ABSTRACT

A cover arrangement for a servicing hole comprises a band of a plurality of supporting bars pivotably connected with one another by chains. The band can be drawn into an open position and pushed into a closed position by a reversing motor driving chain wheels which engage with the chains at the band. Guide means at both ends of each supporting bar move along a horizontal U-shaped path which is continuously surrounded by a guiding web structure ensuring that the band is positively guided and cannot buckle even during its pushing motion.

6 Claims, 9 Drawing Figures

COVER ARRANGEMENT FOR A SERVICING HOLE

BACKGROUND OF THE INVENTION

The invention relates to a cover for servicing holes in automotive service stations comprising a band of parallel support members pivotably connected with one another by links and guided at their ends by a pair of upper horizontal guide rails arranged on upper longitudinally extending supporting rails at the upper edges of the hole respectively, the band longitudinally displaceably arranged at said guide rails, at least one pair of chain wheels fastened on a cross-wise extending shaft mounted for rotation in the upper region of the hole at one end thereof, a driving motor for driving the shaft in opposite directions, the pair of chain wheels being in driving engagement with said links of the band, a pair of lower horizontal guide rails fastened in the bottom area of the hole, a pair of at least substantially vertical guide rails fastened within the hole at said one end thereof, a pair of arc-shaped lower guide rails connecting said vertical guide rails with said pair of lower horizontal guide rails respectively.

A cover arrangement of this kind is known from my German Patent No. 2 646 395. The known cover arrangement uses four deflection wheels at each side of the hole and a pair of endless chains to which the band of supporting members is fastened. When drive motor is driven in one direction, the band is drawn to uncover the hole and, when driven in opposite direction, the band again is drawn to cover the hole.

German Patent Application No. 2 904 399 discloses a cover arrangement that has three supporting member bands arranged side by side and separately driven. The midband is operated in the same manner as in my above mentioned German Patent. The pair of outside bands consist of two halves respectively and only one deflection wheel is provided at each upper end of the hole. According to this concept, both band halves are pushed when moved into the closed position of the hole instead of being drawn. In order to avoid a lifting movement of the band on the supporting rails, guide flanges, overlapping the supporting members, are fastened on the supporting rails. In the open position of the hole, both band halves freely hang down at the frontal ends of the hole.

SUMMARY OF THE INVENTION

One object of the invention is to improve a cover arrangement of the first mentioned art with the aim of reducing the number of deflection rollers and avoiding use of endless chains.

A further object of the invention is to provide a cover arrangement in which the band consisting of a plurality of supporting members pivotably connected with one another, is pushed into its closing position instead of being drawn.

A further object of the invention is to provide a cover arrangement in which a link band, composed of a plurality of heavy loadable supporting members, can easily be drawn into its open position and easily be pushed forward into its closed position without any buckling of the band in order to avoid jamming of the band.

One further object of the invention is to provide a cover arrangement in which the supporting members are provided with guiding means at their ends, and a guiding and supporting rail structure is provided forming a U-shaped path of movement with a pair of horizontal U-legs, whereby the guiding rail structure forms continuous guiding webs at both sides of the hole enclosing the U-shaped path of movement of the guide means of the supporting members.

Another object of the invention is to provide a cover arrangement comprising a band of pivotably connected supporting bars with guide means at the ends thereof whereby the supporting bars in the closed band position are supported directly on low friction slide strips fastened on heavy supporting rails at the upper longitudinal edges of the hole and in the open band position are supported by their guiding means on horizontal guiding rails mounted in the bottom area of the hole.

One further object of the invention is to provide a cover arrangement, in which the supporting members are connected by a pair of chains, whereby the chain members have a length respectively which is at least substantially equal with the width of each supporting element.

These and further objects, features and advantages of the invention will become apparent from the following description of preferred embodiments of the invention and the claims.

DETAILED DESCRIPTION OF THE PREFERRED EMBODIMENTS

Figure 1:
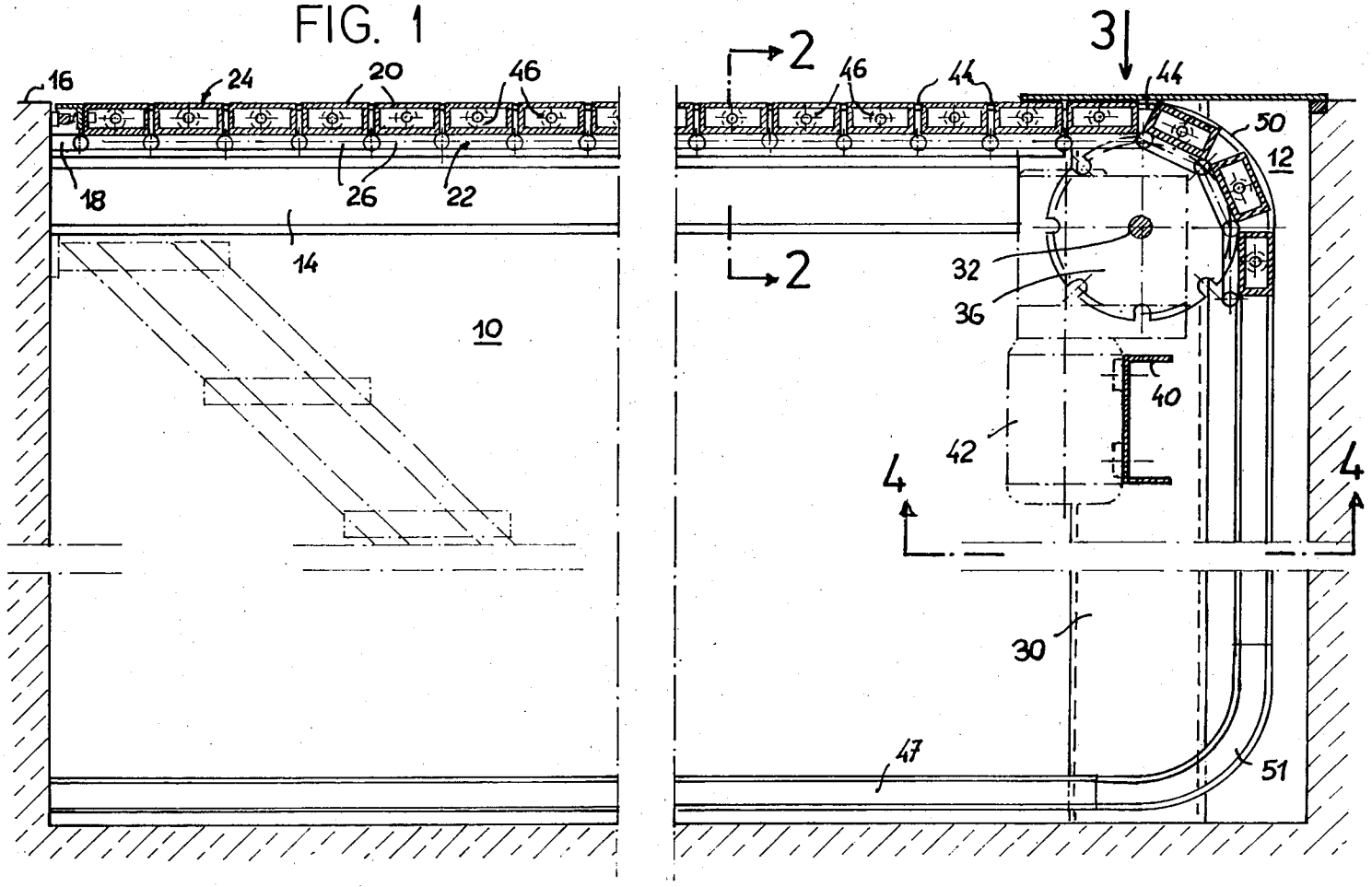
FIG. 1 is a longitudinal section of a hole with the cover band in its closed position.
Figure 2:
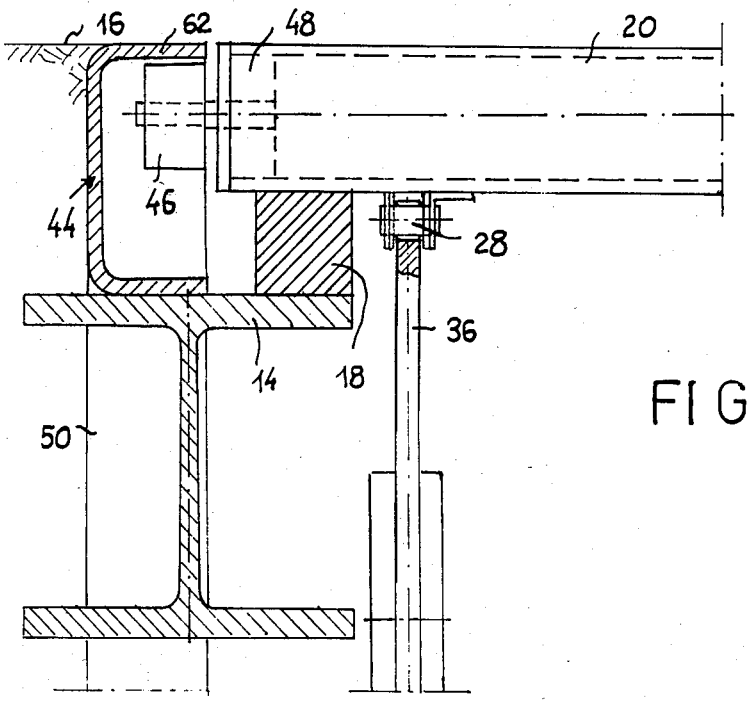
FIG. 2 is a cross-section taken along line 2—2 of FIG. 1 and showing a detail of the supporting and guiding structure.

An assembly hole 10 has an enlarged head area 12 at one end. In the non-broadened area, a pair of supporting rails 14 are fastened at the longitudinal walls of the hole, slightly below the floor 16. Low-friction slide strips 18 are fastened on the upper webs of the supporting rails 14 adjacent the inner edges thereof. A band 24 consisting of a plurality of supporting bars 20 connected with one another by a pair of chains 22 is supported on the strips 18. Each chain member 26 has a length equal with the width of the supporting bars 20 and links 28 of the chain 22 are arranged between the supporting bars 20 respectively.

Vertical mounting bars are fastened to the upper portions of the side walls of the enlarged head areas 12. A shaft 32 is connected to the mounting bars 30 for rotation. A pair of chain wheels 36 engaging the chains 22 are fastened on the shaft 32. The chain wheels 36 are provided with peripheral recesses receiving the links 28 of the chains 22. A cross bar 40 extends between the pair of mounting bars 30 and is fastened thereon. A reversible driving motor 42, by a gear unit, is drivingly connected with the shaft 32. Thus, the chain wheels 36 form deflection means for the cover band 24.

An upper guide rail 44 of U-shaped cross-section is fastened on each supporting rail 14. The guide rail 44 opens to the interior of the hole 10 and the upper guide flange 62 of which is flush with the floor 16. The guide rail 44 is outwardly offset with respect to the mid plane of the supporting rail. The peripheral walls of the supporting bars 20 end adjacent the opposite guide flanges 62 leaving a small space therebetween. The upper surface of each one of the supporting bars is flush with the upper surface of the guide flange 62.

At each end of the supporting bar 20, a guide roller 46 is mounted for rotation about an axis coinciding with the longitudinal central axis of the supporting bar 20. The guide rollers 46 protrude outwardly from the supporting bar 20 into the interior of the guide rails 44 respectively. The guide rollers 46 are mounted on axles fastened in plugs 48 which are inserted in the ends of the supporting bars 20.

It should be noted that between the guide rollers 46 and the upper guide flange 62 a small interspace is formed and that the guide rollers 46 are spaced from the bottom flange of the guide rail 44 to a greater extent. Therefore, the load of the band 24 is transmitted only via the slide strips 18 on to the supporting rails 14 but not via the rollers 46.

The guide rails 44 extend beyond the supporting rails 14 and end substantially in the vertical plane containing the axis of shaft 32. The guide flange 62 is continuously connected with an arc-shaped web 50 which forms a quarter circle with its center coinciding with the axis of shaft 32. The lower end of the arc-shaped web 50 is continuously connected with an outer flange of a vertical guide rail 52, which is of U-shaped cross-section, and the inner flange and the outer flange of the guide rail 52 form an interspace substantially equal with the diameter of the guide rollers 46.

The lower end of the vertical guide rail 52 is continuously connected with a lower arc-shaped guide rail 51, which comprises a pair of coaxially arranged guide webs leaving a radial space there-between which is equal with the inner width of the vertical guide rail 52. Lower horizontal guide rails 47 having the same cross-section as the vertical guide rail 52 are continuously connected with the arc-shaped guide rails 51 at both sides of the hole 10 and mounted at the side walls thereof near the bottom of the hole.

When the motor 42 is started to open the hole 10 the supporting bars 20 slide smoothly on the slide strips 18 along the upper supporting rails 14. Because the band 24 is drawn, the roller 46 are nonoperative during the horizontal movement along the upper moving path. However, the rollers 46 begin to operate as guide rollers when they run into the circular path surrounded by the arc-shaped plates 50 thus holding the links 28 in the recesses of the chain wheels 36. The band therefore is smoothly guided downwards and, after having reached the lower arc-shaped guide rail 51, the guide rollers 46 begin to support the band along the further moving path when they run on the lower web of the arc-shaped rail 51 and the lower horizontal guide rail 47. Should the resistance of the pushed band portion increase, no buckling can occur because of the upper webs of the circular guide rails 51 and the associated lower horizontal guide rails 47. The inner circular web of the lower arc-shaped guide rail 51 in this embodiment can be omitted.

When the motor 42 is started in opposite direction the lower band portion is drawn and the upper portion is pushed in direction of the closing position of the band. This portion is subjected to buckling, that means the band tends to be lifted from the slide strips 18. This lifting, however, is limited by the guide rollers 46 which contact the upper guide flanges 62 of the guide rails 44.

Figure 5:
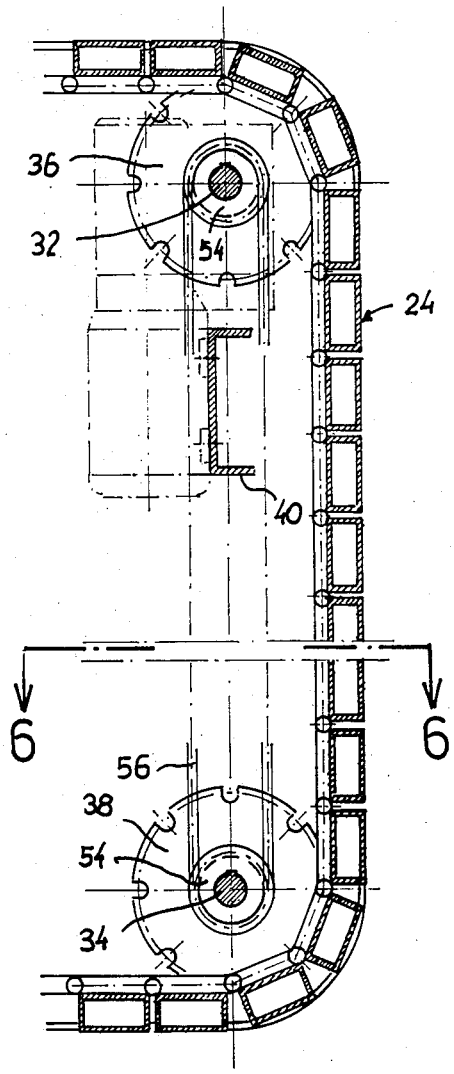
FIG. 5 shows a longitudinal section of an alternative embodiment of a driving arrangement for the cover band.
Figure 6:
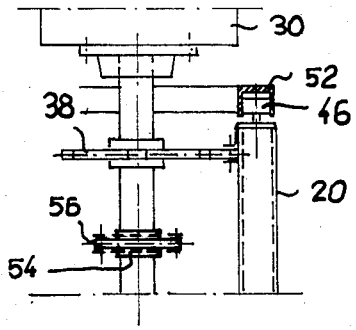
FIG. 6 shows a cross-section along 6—6 of FIG. 5.

In the embodiment shown in FIGS. 5 and 6, a second rotable shaft 34 is mounted vertically below the shaft 32 and the axis of which coincides with the center of curvature of the arc-shaped guide rail 51. The shaft 32 carries a pair of chain wheels 38 which correspond to the chain wheels 36 and operate to engage with the chains 22. On both shafts 32, 34 further pairs of chain wheels 54, 54 are fastened respectively and a pair of endless chains 56, 56 are looped around. The chain wheels 36, 38 therefore rotate synchroneously and the hanging portion of the band 24 is relieved from load when the lower band portion is moved on the lower horizontal rails 51.

Figure 9:
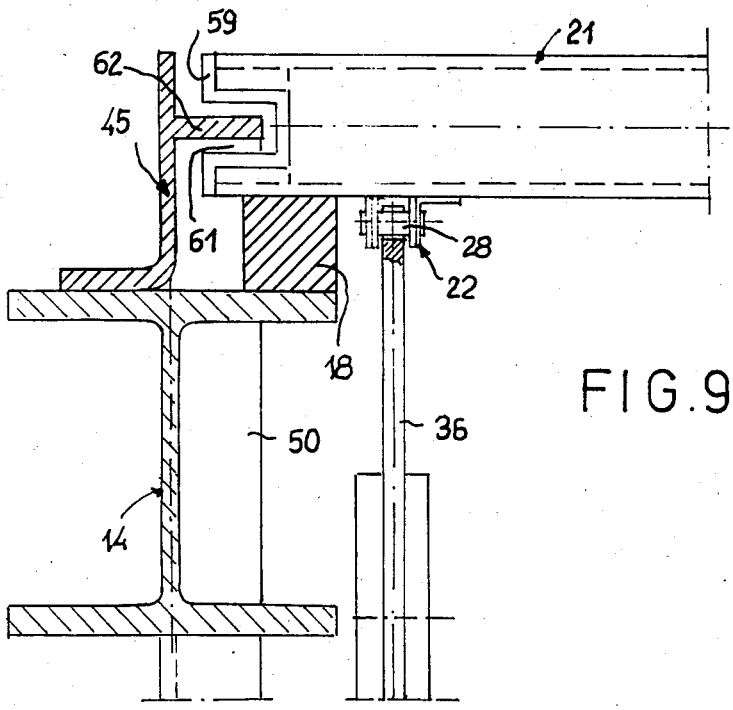
FIG. 9 shows a cross-section of an alternative detail similar to FIG. 8.
Figure 3:
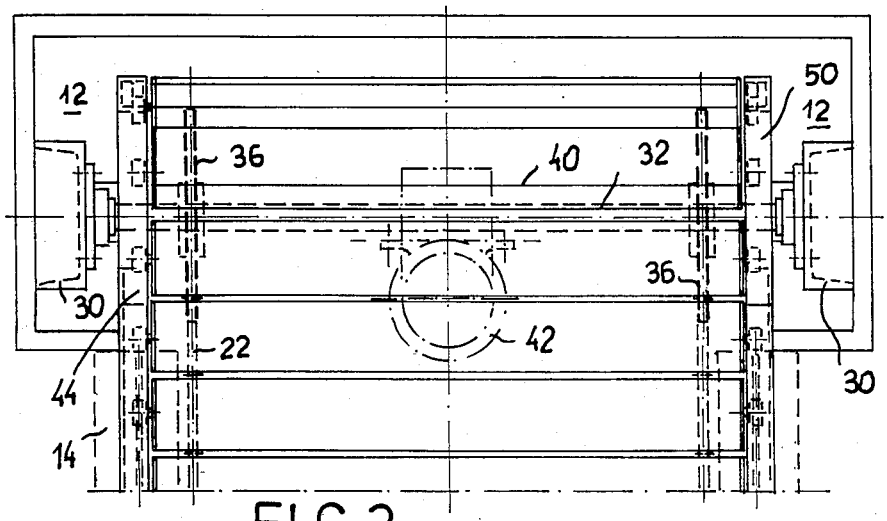
FIG. 3 shows a plan view of the end portion of the cover arrangement in the direction of the arrow 3 of FIG. 1.
Figure 4:
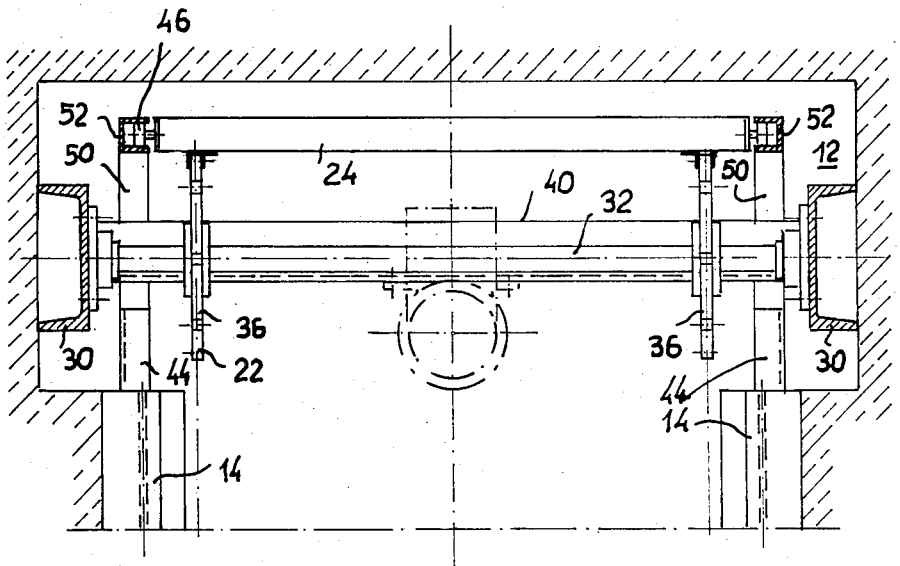
FIG. 4 is a cross-section along 4—4 of FIG. 1.
Figures 7, 8:
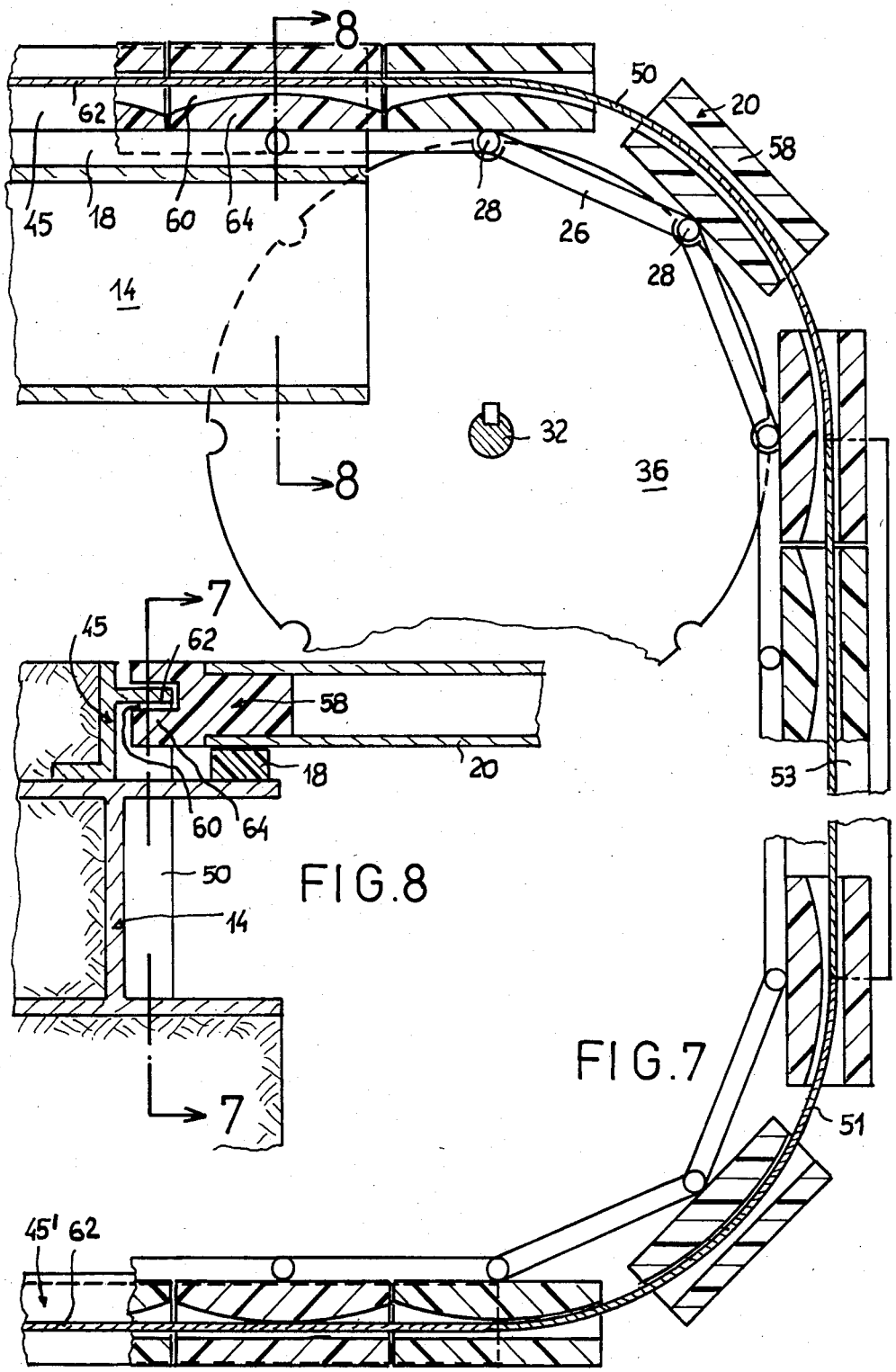
FIG. 7 shows a longitudinal section of an alternative embodiment of a guide structure for a band of supporting members along line 7—7 of FIG. 8.
FIG. 8 shows a cross-section along line 8—8 of FIG. 7.

In FIG. 7 to FIG. 9, a guide rail 45 is shown having a reversed Z-profile with the upper guide flange 62 downwardly offset from the upper edge of the vertical web. Instead of roller axle carrying plugs 48, guide plugs 58 are inserted in the supporting bars 20. Each guide plug 58 has a slot 60 extending therethrough, into which the guide flange 62 projects with upper, lower and side clearances with respect to the slot 60. The guide flange 62 runs tangentially in the circular web 50 and the web 50 is connected with a vertical web of a L-shaped vertical guide rail 53. The lower end of that vertical web is continuously associated with a circularly curved web 51 and this in turn runs in the guiding flange 62 of the lower horizontal guide rail 45'. The guide flanges 62 and the webs of the guide rails 50, 51, 53 form a continuous guide path.

In contrast to the aforementioned embodiment, the links 28 of the chain members 26 are arranged at the midwidth of each supporting bar. The arc-shaped webs 50 therefore can be precisely arranged in a concentric way with respect to the axis of shaft 32. The guide portions 64 of the plugs 58 below the slots 60 which in their operation correspond to the guide rollers 46 have circularly curved guiding surfaces and the radius of curvature is substantially equal with that of the arc-shaped web 50. When the band 24 is pushed against a remarkable sliding resistance the supporting bars 20 get lifted slightly until the highest points in the middle of the guide portions 64 of the guide plugs 58 contact the lower surface of the guide flange 62. Thanks to the shape of the guiding portion 64, the contact takes place only at the small highest middle area of the curved guiding surface of portion 64 and therefore only a small sliding resistance is created.

FIG. 9 shows 15 a cross-section similar to FIG. 8 showing a modification. The supporting bars 21 are somewhat longer and extend partly below the guide flange 62 of the guide rail 45. A slot 61 is provided in the ends of the supporting bar 21 and a plastic end plug inserted in both ends of the bar. The end plug also has a through-going slot with sufficient height and longitudinal dimensions such that any contact between the guiding flange 62 and the plug 59 is avoided when the supporting bar rests on the slide strip 18 in loaded or unloaded condition or is drawn along the slide strip 18.

The embodiment shown in FIGS. 1 to 6 has the advantage that the vertical clearance of the guide rollers 46 in the U-shaped upper guide rails 44 can be made greater than the corresponding clearance in the vertical guide rails 52. This simplifies the construction because it must be warranted that the rollers 46 in the guide rails 44 never get in contact with the rail surface therebelow. Therefore, it is advantageous to make the interior height of the running channel formed by the upper horizontal guide rail 44 greater than the interior width of the vertical guide rail 52, the lower arc-shaped guide rail 51 and the lower horizontal guide rail 47. This is applicable not only if rollers 46 are used as guide means but also in connection with slide plugs overlapped by the guide flanges 62. In the embodiment of FIGS. 7 to 9, therefore, the slots 60 and 61 respectively should form channels of remarkable height, so that enough clearance is provided with respect to the thin-walled guide flange 62 of the upper horizontal guide rail 45. This clearance should be reduced however in the associated further guide rails and this can be accomplished by using guide webs of greater thickness or double-walled guide webs.

I claim:

1. A cover arrangement for covering and uncovering a servicing hole provided in the floor of an automotive service station, the hole being horizontally elongated and having vertical side surfaces, comprising:

a pair of rail ways extending along opposite sides of the servicing hole; a plurality of parallel, heavy loadable support members, the support members being pivotably connected with one another; and guide means provided at the opposite ends of at least some of the elongated support members for guiding the support members along the pair of rail ways;

each one of said pair of rail ways comprising horizontal upper and lower guide rails horizontally extending along opposite sides of the servicing hole, vertical guide rails vertically extending at one end of the servicing hole, and a pair of upper and lower arc-shaped guide rails each one connecting one of the vertical guide rails with one of the horizontal upper and lower guide rails respectively, the horizontal upper guide rail comprising a supporting rail undergripping the plurality of support members in a servicing hole covering position and a guide flange overgripping the guide means provided at the ends of at least some of said support members; said guide flange, said pair of upper and lower arc-shaped guide rails, said vertical guide rail and said horizontal lower guide rail forming a continuous guide surface; and a pair of parallel chains longitudinally extending at the lower side of the plurality of support members in the servicing hole covering position, each chain comprising a number of chain members equal with the number of support members, means for fastening each chain member between its ends at a bottom wall of one of the supporting members, links connecting said chain members with one another, each link arranged in a center plane between a pair of adjacent chain members; a transverse shaft; a pair of upper chain wheels fastened on the transverse shaft mounted for rotation within the servicing hole; and an electric motor operably connected to the transverse shaft for reversibly rotating the transverse shaft, said transverse shaft being arranged below the transition point between the guide flange on the upper one of the pair of upper and lower arc-shaped guide rails, the upper arc-shaped guide rail being curved coaxially with the transverse shaft, and the chain wheels being in driving engagement with the links of the pair of chains.

2. A cover arrangement as claimed in claim 1, wherein the guide means comprises a roller having a rotation axis extending parallel to the length of the support members, and the roller being spaced from the supporting rail when the support members are supported on said supporting rail.

3. A cover arrangement as claimed in claim 1, further comprising a pair of lower chain wheels engaged with the links and coaxially arranged with respect to the lower arc-shaped guide rail, and endless driving means operatively connecting the pair of lower chain wheels and the pair of upper chain wheels.

4. A cover arrangement as claimed in claim 1 further comprising a low-friction slide strip mounted on the supporting rail so as to support the support members, the slide strip being arranged parallel and adjacent to the guide rail.

5. A cover arrangement as claimed in claim 1, wherein the upper and lower horizontal guide rails and the vertical guide rails include a U-shaped cross-section and at least the upper ones of the arc-shaped, guide rails are in the form of arc-shaped plates and wherein the vertical guide rail has an interior width which is smaller than the interior height of the upper horizontal guide rail.

6. A cover arrangement as claimed in claim 1, wherein the guide means include plugs having end slots extending therethrough connected to the ends of the supporting members and wherein the guide flanges protrude into the end slots.

* * * * *